US008647250B2

(12) United States Patent
French et al.

(10) Patent No.: US 8,647,250 B2
(45) Date of Patent: Feb. 11, 2014

(54) PANEL STRUCTURE WITH SCORED AND FOLDED FACING

(75) Inventors: Lawrence James French, Wallingford, CT (US); Robert Edward Jaegers, Lake Zurich, IL (US); Scott David Daniel, Vernon Hills, IL (US)

(73) Assignee: Hexacomb Corporation, Deerfield, IL (US)

( * ) Notice: Subject to any disclaimer, the term of this patent is extended or adjusted under 35 U.S.C. 154(b) by 275 days.

(21) Appl. No.: 12/816,166

(22) Filed: Jun. 15, 2010

(65) Prior Publication Data

US 2011/0132236 A1 Jun. 9, 2011

Related U.S. Application Data

(60) Provisional application No. 61/267,763, filed on Dec. 8, 2009.

(51) Int. Cl.
*B31B 1/14* (2006.01)

(52) U.S. Cl.
USPC ..... 493/344; 493/343; 493/355; 493/356; 493/379; 493/373; 493/964; 493/966; 83/863; 108/51.3; 108/57.34

(58) Field of Classification Search
USPC ..... 493/374, 379, 393, 396, 964, 397, 966, 493/340, 352, 355, 356, 370, 373, 343, 493/344; 108/51.11, 51.3, 57.29, 57.34; 83/863
See application file for complete search history.

(56) References Cited

U.S. PATENT DOCUMENTS

| | | | | |
|---|---|---|---|---|
| 3,655,478 | A | 4/1972 | Geschwender | |
| 3,952,672 | A * | 4/1976 | Gordon et al. | 108/51.3 |
| 4,421,230 | A * | 12/1983 | Stanton | 206/378 |
| 5,269,219 | A | 12/1993 | Juvik-Woods | |
| 5,433,156 | A * | 7/1995 | Hutchison | 108/51.3 |
| 5,941,177 | A | 8/1999 | Anderson | |
| 6,076,475 | A * | 6/2000 | Kuhn et al. | 108/51.3 |
| 6,294,114 | B1 * | 9/2001 | Muirhead | 264/40.6 |
| 6,357,364 | B1 | 3/2002 | Maloney et al. | |
| 6,659,020 | B1 * | 12/2003 | Ball | 108/57.28 |
| 6,915,747 | B1 * | 7/2005 | Sewell | 108/51.3 |
| 7,322,480 | B2 | 1/2008 | Bragadeste et al. | |

(Continued)

FOREIGN PATENT DOCUMENTS

| | | |
|---|---|---|
| JP | 11123788 | 11/1999 |
| WO | WO 2010049418 | 6/2010 |

OTHER PUBLICATIONS

International Search Report for Application No. PCT/US2010/059498 mailed on Mar. 14, 2011.

*Primary Examiner* — Christopher Harmon
(74) *Attorney, Agent, or Firm* — Klarquist Sparkman, LLP

(57) ABSTRACT

A panel structure having a low-density core that can withstanding loads normal to a first primary surface, and a first facing of high-density sheet material that can extend along the first primary surface. The high-density sheet material can be laminated on the core such that the laminated core and facing cooperatively resist bending loads and loads along the primary surface. The first facing can extend from the first primary surface on a side of the core along a secondary surface, which can be non-parallel to the first primary surface. The first facing can bend along a score line between the first primary surface and the secondary surface.

18 Claims, 9 Drawing Sheets

(56) References Cited

U.S. PATENT DOCUMENTS

| | | | | |
|---|---|---|---|---|
| 7,857,934 | B2 * | 12/2010 | Simmons et al. | 156/219 |
| 8,181,580 | B2 * | 5/2012 | Roth et al. | 108/57.25 |
| 2002/0069955 | A1 | 6/2002 | Wang | |
| 2008/0196633 | A1 | 8/2008 | Ho | |
| 2009/0114129 | A1 * | 5/2009 | Smith et al. | 108/57.25 |
| 2010/0107933 | A1 * | 5/2010 | Love | 108/51.3 |

* cited by examiner

PANEL STRUCTURE WITH SCORED AND FOLDED FACING

CROSS-REFERENCE TO RELATED APPLICATIONS

The present application claims priority to U.S. Provisional Application No. 61/267,763, filed Dec. 8, 2009, the contents of which are hereby incorporated by reference in its entirety.

FIELD OF THE INVENTION

The present disclosure relates to a panel structure, and more particularly to a panel structure having a low-density core and a high-density sheet material folded therearound.

BACKGROUND

Various materials are used for constructing boxes, shelves, pallets, and other such objects that are used to hold and/or support a weight of various items. Materials such as paper, wood, metal and plastic can be used in the design and manufacture of such items. The use of paper materials can be cost competitive to materials such as wood, metal, and plastic, while at the same time offering benefits that are not available through the use of traditional wood materials. The benefits of using paper materials are several fold. Paper products can be made lighter than wood, plastic, or metal products, and when formed into a honeycomb structure may have remarkable strength.

Further, paper products can be made biodegradable to allow for disposal without penalty charges or prohibitions from land fills or they can be baled and recycled to paper companies. Because of the ease of working with paper materials and the availability of various honeycomb structures, products can be manufactured in a variety of shapes and sizes to meet any particular requirements.

Panels known in the prior art often employed mechanical folding or pressing methods to form sheet material around the edges panel core. These methods resulted in imprecisely formed edges, which may be rounded, not sharp, with relatively large radii.

U.S. Pat. No. 5,269,219 shows panels that are covered with corrugated material which was scored prior to folding. Scoring is beneficial prior to folding corrugated material, such as cardboard, because the fold is not straight otherwise. Corrugated material, however, is thicker and less dense than solid sheet material, and thus does not have the same beneficial strength versus size characteristics as does solid sheet material.

SUMMARY

One embodiment of a panel structure may include a low-density core configured for withstanding loads normal to a first primary surface. A first facing of high-density sheet material extending along the first primary surface may be laminated on the core such that the laminated core and facing cooperatively resist bending loads and loads along the primary surface, the first facing extending from the first primary surface on a side of the core along a secondary surface, which is non-parallel to the first primary surface. The first facing may include a bend along a score line between the first primary surface and the secondary surface.

The first facing may extend from the first primary surface around the secondary surface to a second primary surface on an opposite side of the core from the first primary surface. The first facing may include another bend along another score line between the secondary surface and the second primary surface. A second facing of high-density sheet material may extend along the second primary surface, wherein the first facing is affixed to an outer surface of the second facing on the secondary surface. The score line is provided in the first facing using a substantially circular blade having a 16-inch diameter.

The first facing may be made of a paper material. The paper material may be a multilayered sheet material. The paper material may have a density between approximately 26 lb./1000 sq. ft.-90 lb./sq. ft. The core may be a honeycomb material. The honeycomb core may be made of a material having more than 70% airspace, and the first facing comprises a material having less than 10% airspace. The first facing may have a significantly greater density than the low-density-core.

The panel structure may include one or more runners provided along a bottom surface of the panel structure that is opposite to the first primary surface. The panel structure may be provided as a wall of a shelf. The panel structure may be provided as a wall of a receptacle.

The bend and score line may be configured for maximizing a flat, printable area along the first primary surface of the receptacle. A printable area on the secondary surface may be provided.

One embodiment of a method of forming a pallet structure may include providing a low-density core configured for withstanding loads normal to a first primary surface, providing a first facing of high-density sheet material that includes first and second portions, the first facing having a score line between the first and second portions, laminating the first portion of the first facing onto the core along the first primary surface in an association to cooperatively resist bending loads and loads along the primary surface, and bending the second portion of the first facing with respect to the first portion of the facing along the score line to produce a crisp bend such that the second portion of the first facing extends on a side of the core along a secondary surface, which is non-parallel to the first primary surface.

The scoring may be conducted after the lamination of the first facing onto the core. The score line is provided using a substantially circular blade having a 16-inch diameter.

The method may further include providing a second score line between the second portion and a third portion of the high-density sheet material and bending the third portion of the first facing with respect to the second portion of the facing along the second score line to produce a bend such that the third portion of the facing extends along a bottom surface of the core that is opposite to the first primary surface.

DETAILED DESCRIPTION

Figure 1A:
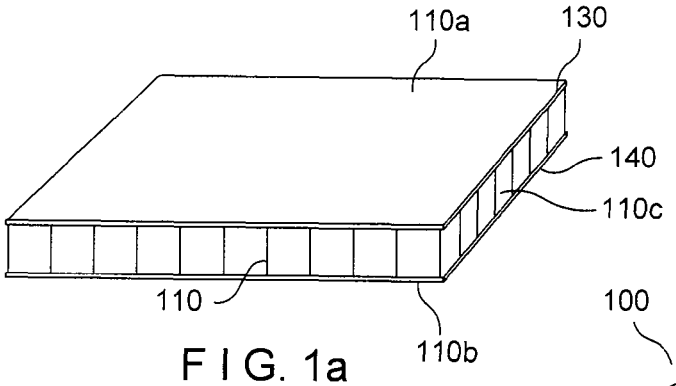
FIGS. 1*a*-1*e* show a panel structure made according to an embodiment of the invention.

Referring to FIG. 1*a*, a method of forming a panel structure is provided. A low-density core 110 can be provided, that can have a honeycomb structure, including an upper surface 110*a*, a lower surface 110*b* and a side surface 110*c*. The low-density core 110 can be configured for withstanding loads normal to a first primary surface 110*a*, such as the upper surface, of the low-density core 110. The lower surface 110*b* can also withstand loads normal to the lower surface 110*b*. The side surface 110*c* can have an upper edge 130 and a lower edge 140.

Figure 1B:
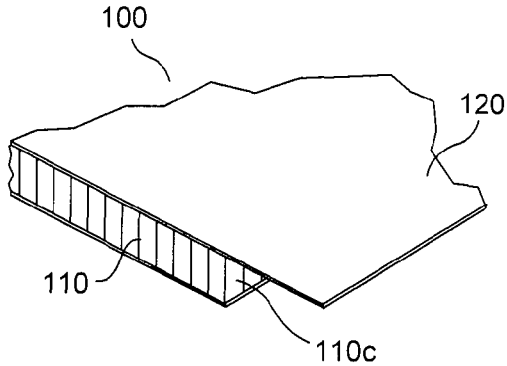

As shown in FIG. 1*b*, a facing 120, that can comprise a high-density sheet material, can be provided that extends along the first primary surface 110*a* to form a panel structure 100. The facing 120 can be laminated on the low-density core 110 along the upper surface 110*a*. The facing 120 can be laminated over a portion or all of the first primary surface 110*a*. Other methods can also be used to adhere the facing 120 over the upper surface 110*a*, such as glues, adhesives, tape, etc. The facing 120 can have a length such as to extend over a side surface 110*c* of the low-density core 110 as shown in FIG. 1*b*.

Figure 1C:
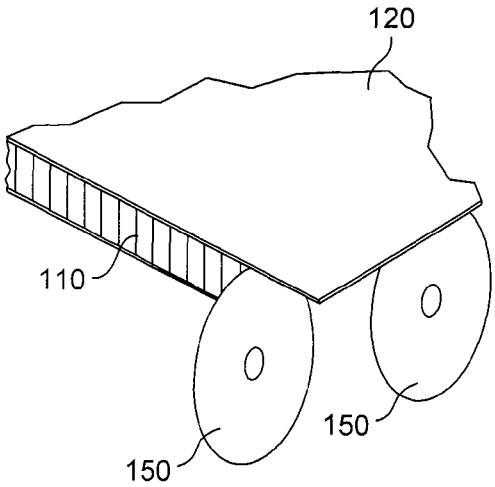

As shown in FIG. 1*c*, a portion of the facing 120 that corresponds to an upper edge 130 of the side surface 110*c* of the low-density core 110 can be scored. Various blades or devices can be used for scoring the high-density facing 120, such as, e.g., a circular scoring blade 150. The circular scoring blade can have any diameter depending on the size/thickness of the facing 120 and/or the size of the panel 100, and can preferably have a diameter between 2"-15", and more preferably a 6" diameter which has been found to provide greater control with a depth of the cut. Of course, the size of the diameter can vary depending on the size and/or thickness of the facing 120. Other methods can also be used for scoring the facing 120, such as, e.g., creasing, shaving a layer, or pressing, and can be conducted independently, before, after, or in conjunction with cutting the core to size. The facing 120 can also be scored before application to the core 100. In this case, the facing 120 can be applied on the core so that the scored portion is placed corresponding to the upper edge 130 of the side surface 110*c*.

Further, a portion of the facing 120 that corresponds to a lower edge 140 of the side surface 110*c* of the low-density core 110 can be scored. Similarly, any blade or device can be used for scoring the high-density facing 120, such as, e.g., a circular blade 160. The blade 160 can be separate from blade 150, such that both parts of the facing 120 (that correspond to the upper edge 130 and lower edge 140) can be scored simultaneously, or one blade can be used to score both portions.

Figure 1D:
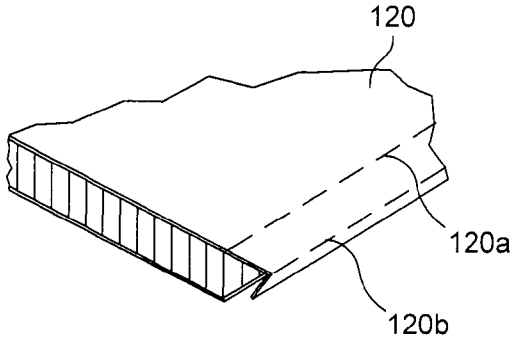
Figure 1E:
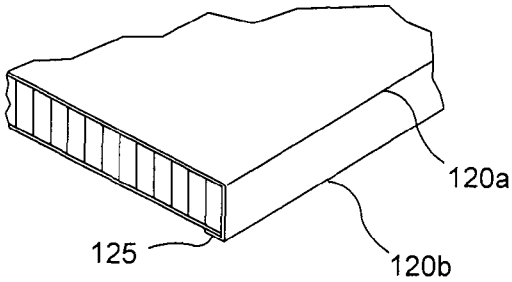

As shown in FIG. 1*d*, an upper portion 110*a* of the facing 120 that corresponds to the upper edge 130 of the side surface 110*c*, and a lower portion 110*b* of the facing 120 that corresponds to the lower edge 140 of the side surface 110*c*, are scored and can be folded along scored portions 120*a*, 120*b*. The facing 120 now provides a cover along the upper surface 110*a* and along the side surface 110*c* of the low-density core 110 as shown in FIG. 1*e*. The facing 120 also extends around the edge 140 to the lower surface 110*b*, forming a lip 125 adhered to the lower surface 110*b*. The scoring and folding provide a crisp uniform edge of the facing 120 along the edges 130 and 140.

In one embodiment, the facing 120 can be extended to cover a bottom surface 110*b* of the low-density core 110, and can also be extended to cover the other three side surfaces of the low-density core 110 as well. In another embodiment, a second facing of high-density sheet material can be provided, similar to the first facing 120, that extends along the primary bottom surface 110*b*, the first facing 120 can be affixed to an outer surface of the second facing on the bottom surface 110*b*.

Figure 1F:
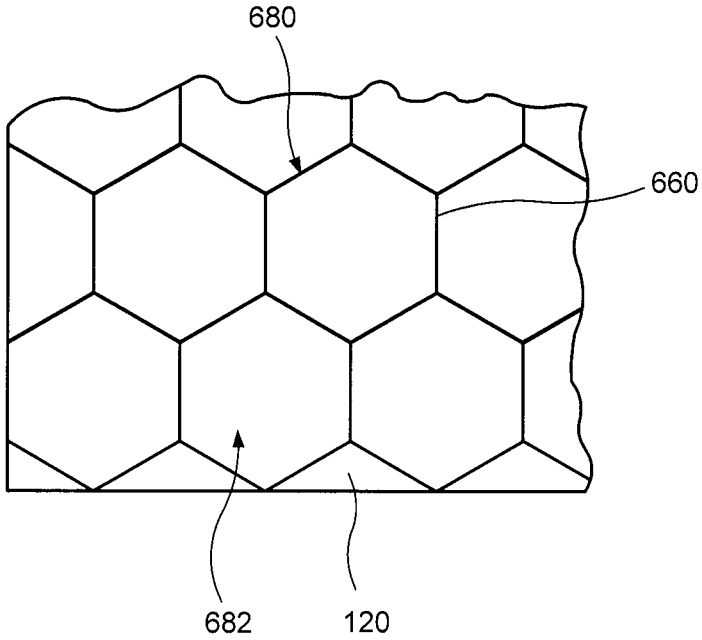
FIG. 1*f* is a top cross-sectional view showing a portion of the core of a panel in accordance with a preferred embodiment of the invention.
Figure 2A:
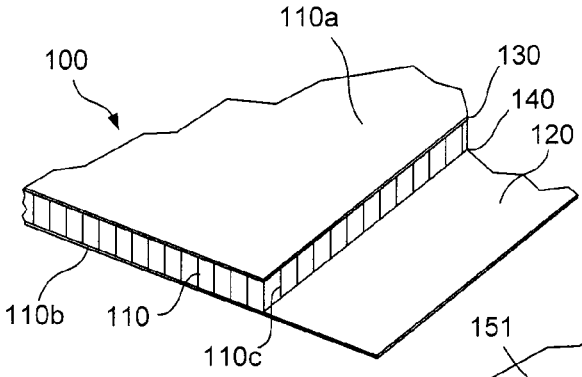
FIGS. 2*a*-2*e* show a panel structure made according to another embodiment of the invention.
Figure 2B:
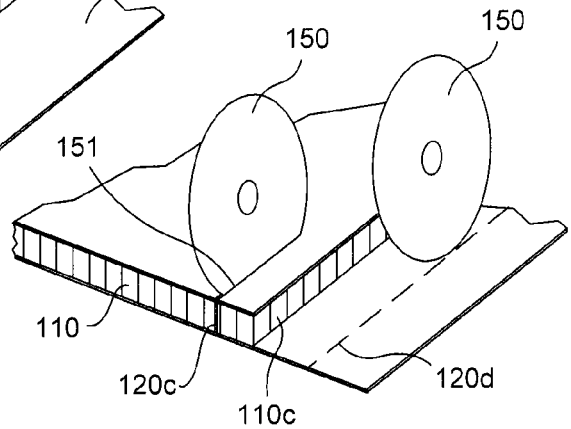
Figure 6:
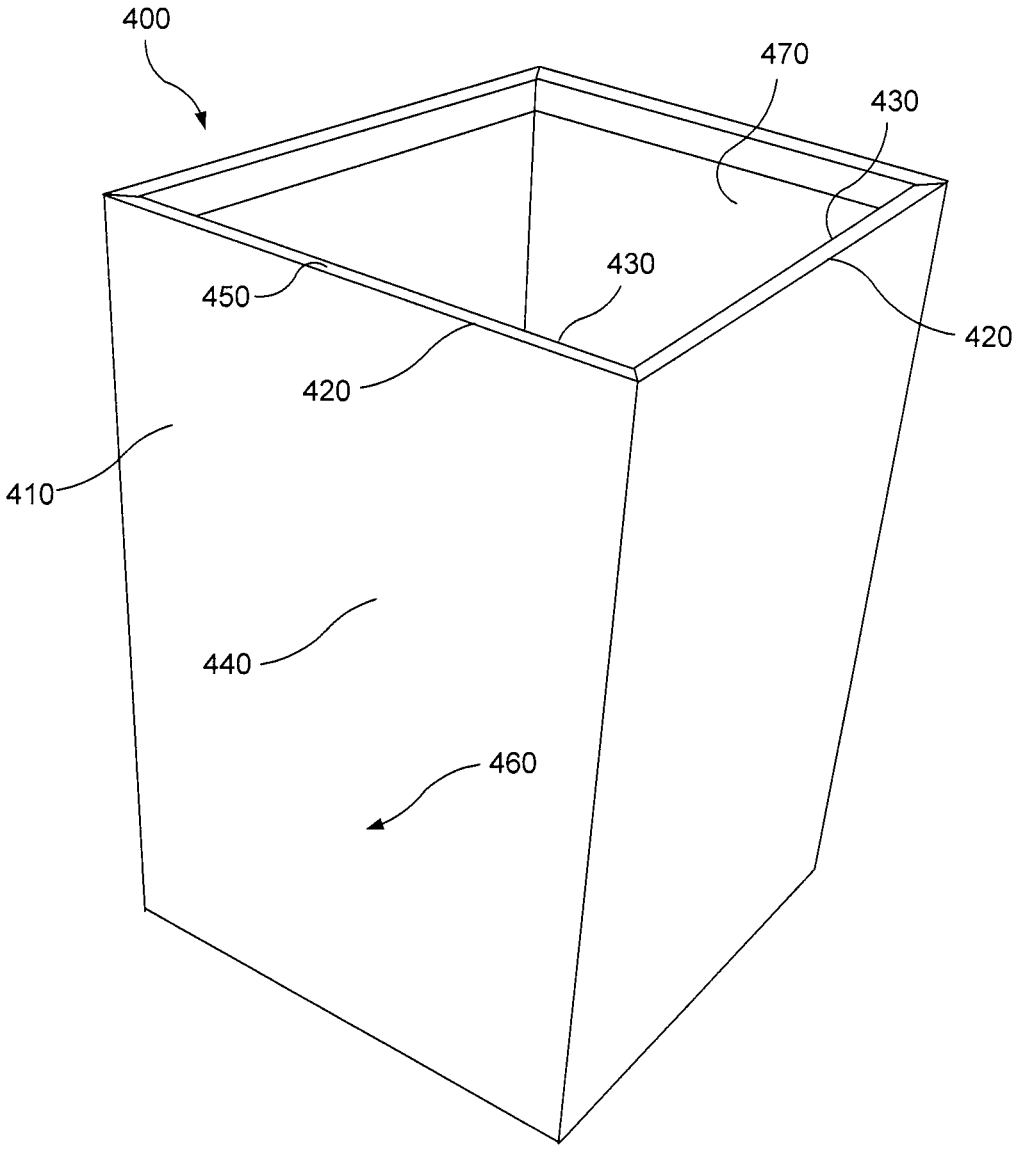
FIG. 6 is a perspective view of a display bin constructed according to the method of FIG. 1.

Referring now to FIG. 1*f*, and with general reference to the embodiments described, preferred embodiments of a panel (e.g., 100, as shown in FIG. 1*a*) or pallet structure (e.g., 200, as shown in FIGS. 2*a*-*b*) in accordance with the present disclosure has a honeycomb core structure 680. The honeycomb structure 680 can have walls 660, defining cells of six walls 660 as shown in FIG. 6, having a hexagonal shape, an octagonal shape, or other suitable shape, such as 3 or 4-sided shapes. The honeycomb structure 680 can provide for a large number of air spaces 682 within or in between the walls 660 to provide for a low-density honeycomb material that can be mostly air by volume. For example, the panels can comprise a material having over 60%, 70%, or 90% airspace, although any amount of airspace may be acceptable. In other embodiments, a corrugated or other low-density structure may be used in place of the honeycomb structure 680. Other materials may also be used.

Furthermore, the material from which facings (e.g., 120, 220, 270) are made are preferably significantly denser than the core, due to their configuration, although they can be made of the same material. In the preferred embodiment, the facings generally do not have airspace within the sheet material, and are made of a solid paper material. In some embodiments, the facings can be made with a material having less than 25% airspace, and preferably less than 10% airspace. Examples of the density of the facings are between 31 lb./1000 sq. ft. and 90 lb./sq. ft., and preferably about 56 lb./1000 sq. ft. The facings are preferably made of a single sheet of material, but may be made of multiple plies, for instance.

Various adhesives can be used to adhere the facings to the honeycomb core, such as PVA glue, EVA glue, water based adhesives, starch based adhesives, HotMelt®, and solventless adhesives. Preferred embodiments may utilize PVA glue, especially as between honeycomb walls 660. The thickness of the disclosed facings may vary, for example, between 0.00788 inches in the case of a 31 lb./1000 sq. ft. density layer, and 0.02728 inches in the case of a 90 lb./1000 sq. ft. density layer. In preferred embodiments, the thickness may vary linearly between 0.00788 inches and 0.02728 inches for layer densities between 31 and 90 lb./sq. ft., as the thickness may vary generally linearly in proportion to density.

The panel or pallet structure of the preferred embodiment is capable of handling loads up to about 2000, 2250, or 2500 lbs. All portions of the panel or pallet structure, including the facings and core, can be made of sheet material, such as paper material, which can provide savings on shipping costs and can be recyclable and biodegradable, and can provide a lightweight, low-cost structure. Furthermore, the use of paper materials can be cost competitive to materials such as wood, metal, and plastic, while at the same time offering benefits that are not available through the use of traditional wood materials. Paper products can be made lighter than wood, plastic, or metal products, and when formed into a honeycomb structure may have remarkable strength. Because of the ease of working with paper materials and the availability of various honeycomb structures, products can be manufactured in a variety of shapes and sizes to meet any particular requirements. Exemplary honeycomb panels which may be used with the present disclosure include those which are produced under the Hexacomb® brand by Pregis Corporation. Other embodiments of the panel structure described above are also possible.

Referring now to FIG. 2*a*, a facing 120 can be provided that extends along the lower surface 110*b* to form a panel structure 100. The facing 120 can be laminated on the low-density core 110 along the lower surface 110*b*. The facing 120 can be laminated over a portion or all of the surface 110*b*. Other methods can also be used to adhere the facing 120 over the lower surface 110*b*, such as glues, adhesives, tape, etc. The facing 120 can have a length such as to extend beyond a side surface 110*c* of the low-density core 110, as shown in FIG. 2*a*.

Figure 2C:
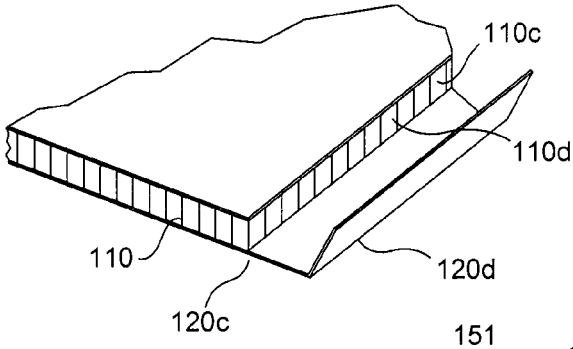

Referring now to FIG. 2*b*, a circular blade 150 may cut through the core 110 along a line 151 which is parallel to the side surface 110*c*, and located interior to the side surface 110*c*. The distance between line 151 and side surface 110*c* may be approximately the height of the core. In this manner, the circular blade may cut off the end portion of the core defined by the distance between the line 151 and the side surface 110. Thus, an new side surface 110*d* is exposed, as is shown in FIG. 2*c*. At the same time as cutting through the core, or on a second pass, the circular blade 150 may score the facing 120 at the position of the cut, shown in FIG. 2*b* as scored portion 120*c*. Additionally, the blade 150 (or optionally a second blade 150) may score the facing 120 at a position which is defined by the a length equaling the thickness of the core 110 (the distance between upper edge 130 and lower edge 140) extended from the scored portion 120*c*. This second scored portion is shown as portion 120*d* at FIG. 2*b*.

FIG. 2*c* depicts the scored portions 120*c* and 120*d*, with the portion of facing 120 which extends beyond scored portion 120*d* folded at scored portion 120*d*.

Figure 2D:
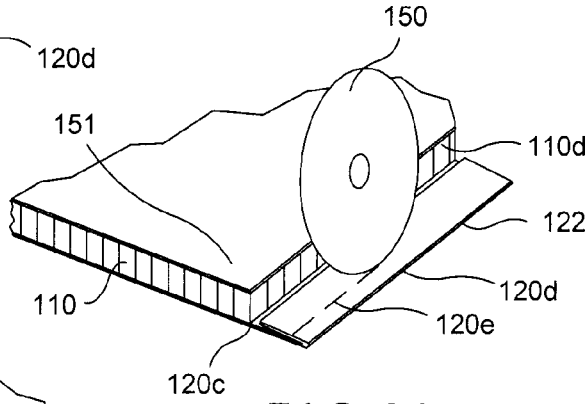

As shown at FIG. 2*d*, a circular blade 150 may cut away a portion of the facing 120 at line 120*e* (the facing 120 shown as having been folded over itself at scored portion 120*d*). Thus, after this cut, a smaller portion of facing 120 extends beyond scored portion 120*d*, as defined by area 122 shown at FIG. 2*d*. The area 122 may be greater than the height of the core, so as to allow the portion area 122 to adhere to the surface 110*a*.

Figure 2E:
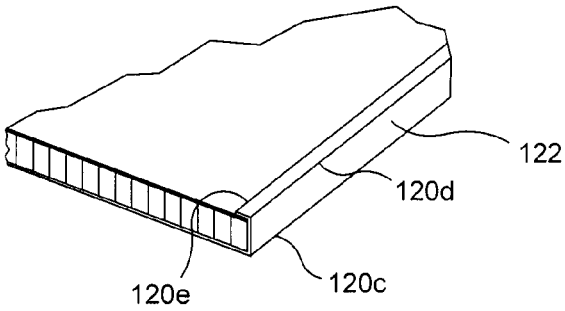

At FIG. 2*e*, the surface 120 is shown folded over the side surface 110*d* of the core 110. A fold has been made at scored portion 120*c*, corresponding to lower edge 140, and a fold (having previously been made at scored portion 120*d*) is matched with and positioned adjacent to upper edge 130. The area 122 of the facing 120 is thereby positioned against the upper surface 110*a*, extending inwardly from the upper edge 130 to cut 120*e*. The facing 120 now provides a cover along the lower surface 110*b* and along the new side surface 110*d* of the low-density core 110 as shown in FIG. 2*e*. The scoring and folding provide a crisp uniform edge of the facing 120 along the edges 130 and 140.

Although the shape of the low-density core 110 is four-sided, such a square or rectangular shape, one of ordinary skill in the art would understand that other such shapes can be provided, such as polygonal, circular, triangular, etc., and are not limited to such. The laminated low-density core 110 and facing 120 can cooperatively resist bending loads and loads along the primary upper surface 110*a* and the side surface 110*c*, as well as the primary bottom surface 110*b*.

The upper surface 110*a* of the low-density core 110 can be configured to vertically support weight of a load that is supported on the upper surface, and one or more side surfaces 110*c* can be configured to protect the panel structure 100 from any force or impact against the side surface 110*c*. In the embodiment shown, the honeycomb structure of the low-density core 110 can be sufficiently strong to withstand typical vertical forces applied. This is assisted by the vertical orientation of the honeycomb walls of the low-density core 110, and their association with each other at non-parallel angles in the horizontal direction.

The honeycomb structure of the low-density core 110, however, are typically more prone to crushing or puncturing due to impacts, especially in a horizontal direction, or perpendicular to the honeycomb walls. For instance, exposed portions of the honeycomb low-density core 110 may crumple when exposed to a force or impact along the horizontal sides. The scoring and folding of the facing 120 along the side surface 110*c* of the low-density core 110 provide protection that has been found to be greater than just providing a wrap around the low-density core 110. The actual scoring and subsequent folding provides the side surface 110*c* of the low-density core 110 with stronger resistance to any impact along the side surface of the panel structure 100.

One of ordinary skill in the art would understand that different surfaces can be protected using the scoring/folding technique described above. For example, it may be important to protect the side surface 110*c* of the low-density core 110. In some embodiments it may be important to protect side surface 110*c* and a side surface opposite side surface 110*c*, and/or a side surface adjacent to the side surface 110*c*. The scoring and folding technique described above has been found to be stronger and more resistant to tearing and/or crushing than simply folding a sheet around a low-density core 110.

Figure 3:
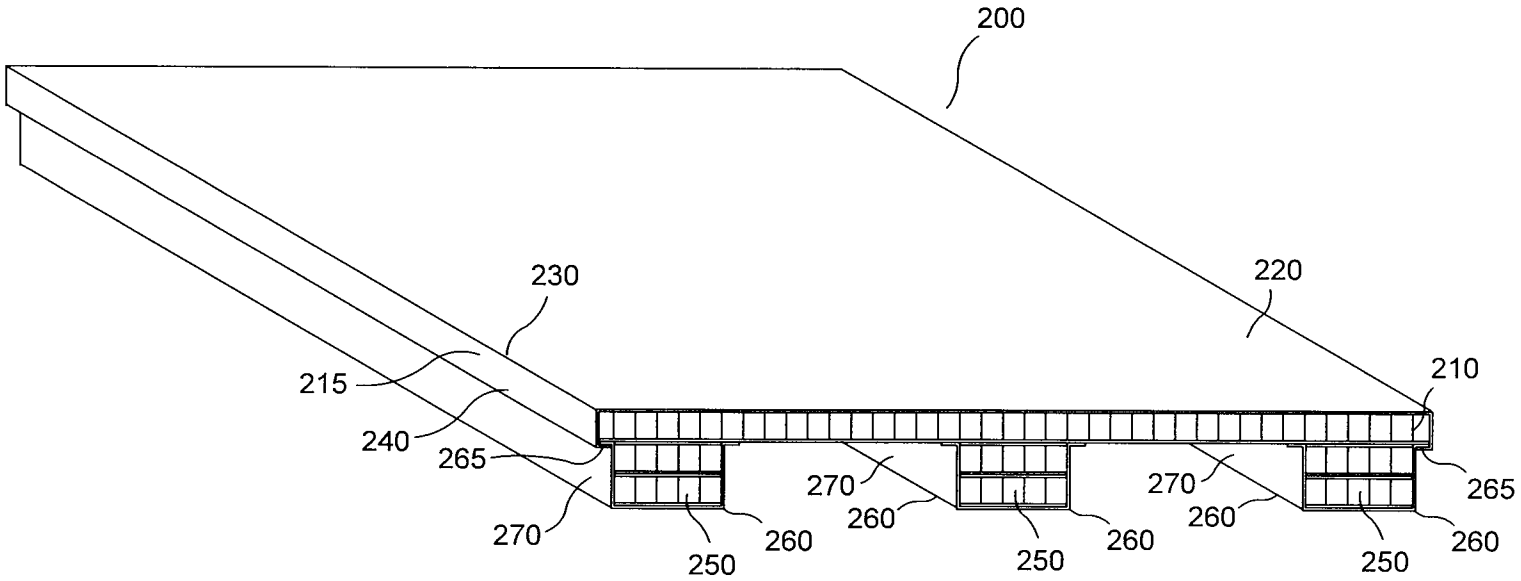
FIG. 3 is a perspective view of a pallet structure constructed using the method of FIG. 1.
Figure 4:
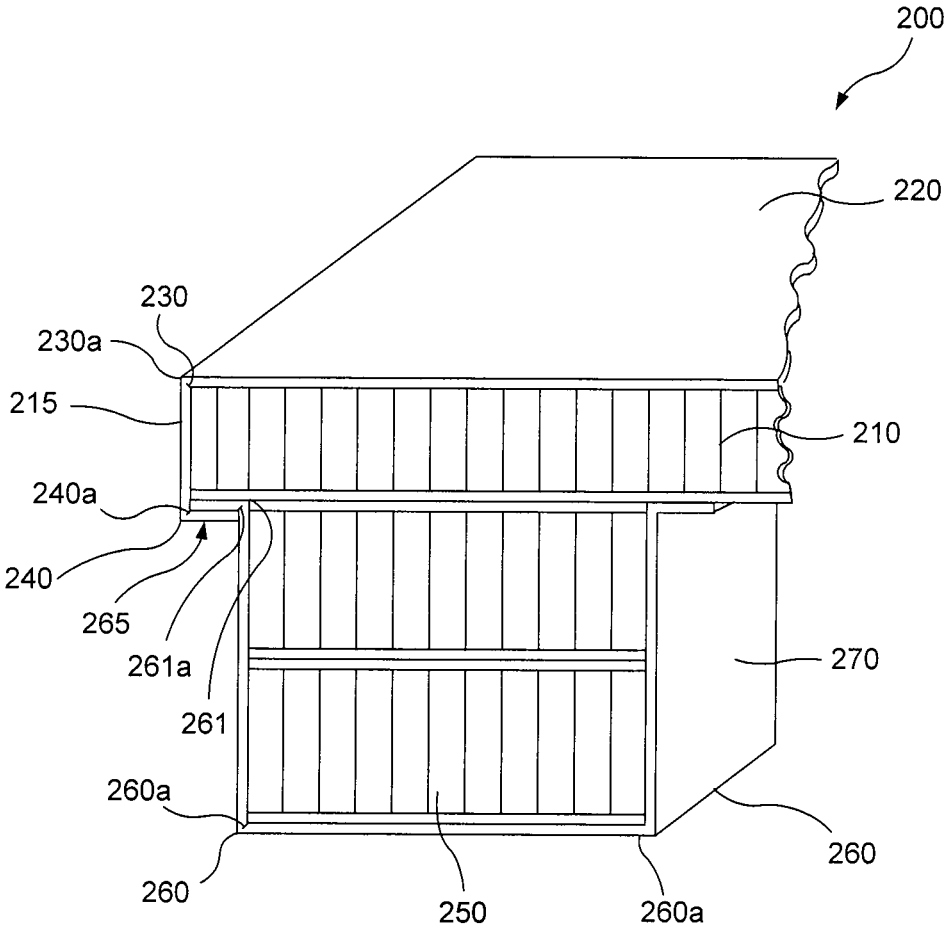
FIG. 4 is a perspective view of a pallet structure constructed using the method of FIG. 1.

The pallet structure 200 shown in FIGS. 3 and 4 has a low density-core 210 and a facing 220 provide for a deck of a pallet structure, with runners 250. Two or more runners 250 may be provided, and in preferred embodiments 3 runners may be provided. Two runners may be provided on opposite ends of the pallet structure 200, and a middle runner along a middle portion of the pallet structure 200. The runners 250 can be interrupted along the length of the runners, providing cutouts, spaces, or holes between sections of the runners to receive a forklift from another angle, such as from the lateral sides of the pallet structure 200, so that the pallet structure can be lifted from the front, back or sides.

The facing 220 can be provided along an upper surface of the low density core 210, which can sustain a load that is placed normal to the upper surface of the low density core 210. The facing 220 can be laminated on the upper surface of the low density core 210, and can be scored and folded along an upper edge 230 (scored fold 230*a*) and lower edge 240 (scored fold 240*a*) of the low density core 210. The facing may extend beyond the fold about the lower edge 240, to an area 265 on the lower surface of the deck between the edge 240 and the runner 250. Such scoring and folding can provide for resistance to impacts in a horizontal direction to the side surface 215 of the pallet structure 200. A similar scoring and folding technique can be applied to the opposite side surface of the pallet structure 200, and the facing may extend on a portion or all of the bottom surface of the low-density core 210.

The runners 250 can also comprise a low density structure, such as one or more layers of a honeycomb structure. Paper material may be provided between layers of honeycomb structure of the runners 250, with adhesives therebetween to form a single solid structure as the runner 250. A facing 270 may be provided along the exterior surface of the runners 250 similar to the facing 220. The facing can be scored and folded along one or both bottom edges 260 (scored fold 260*a*) of the runners 250, thus providing a crisp uniform edge along the edges 260 of the runners 250. This may provide more resistance to bending, crushing, and wear/tear of the runners 250 when subjected to loads or side impacts.

As shown in FIG. 4, the facing 220 over the core 210 and facing 270 over the runners 250 may overlap at areas 265, whereat the lower surface of the core panel extends beyond the interface with the runner 250. In order to form the overlap, a portion of the facing 220 may extend into beyond edge 240 of the core 210, into area 265 toward the runner 250. A scored fold 240*a* may therefore be made around edge 240. Similarly, a portion of the facing 270 may extend along the lower surface of the core panel into area 265, past edge 261 of the runner 250. A scored fold 261*a* may be made at edge 261, as described above. With respect to any of the scored folds 230*a*, 240*a*, 260*a*, or 261*a*, the scoring may be made on the interior side of the facing, as shown, or on the exterior side of the facing. In the embodiment shown, the facing 220 overlaps the facing 270 in area 265. Area 265 may be between ¼" to 3" in width, and can preferably be approximately between ½" to 2" in width. Adhesives may be applied at all points whereat facings 220, 270 contact core 210 and runners 250, and also between facings at the overlap at area 265. In this manner, the runner 250 may more securely be affixed to the core panel 210 as their respective facings 270,220 overlap and are adhered to one another.

Figure 5:
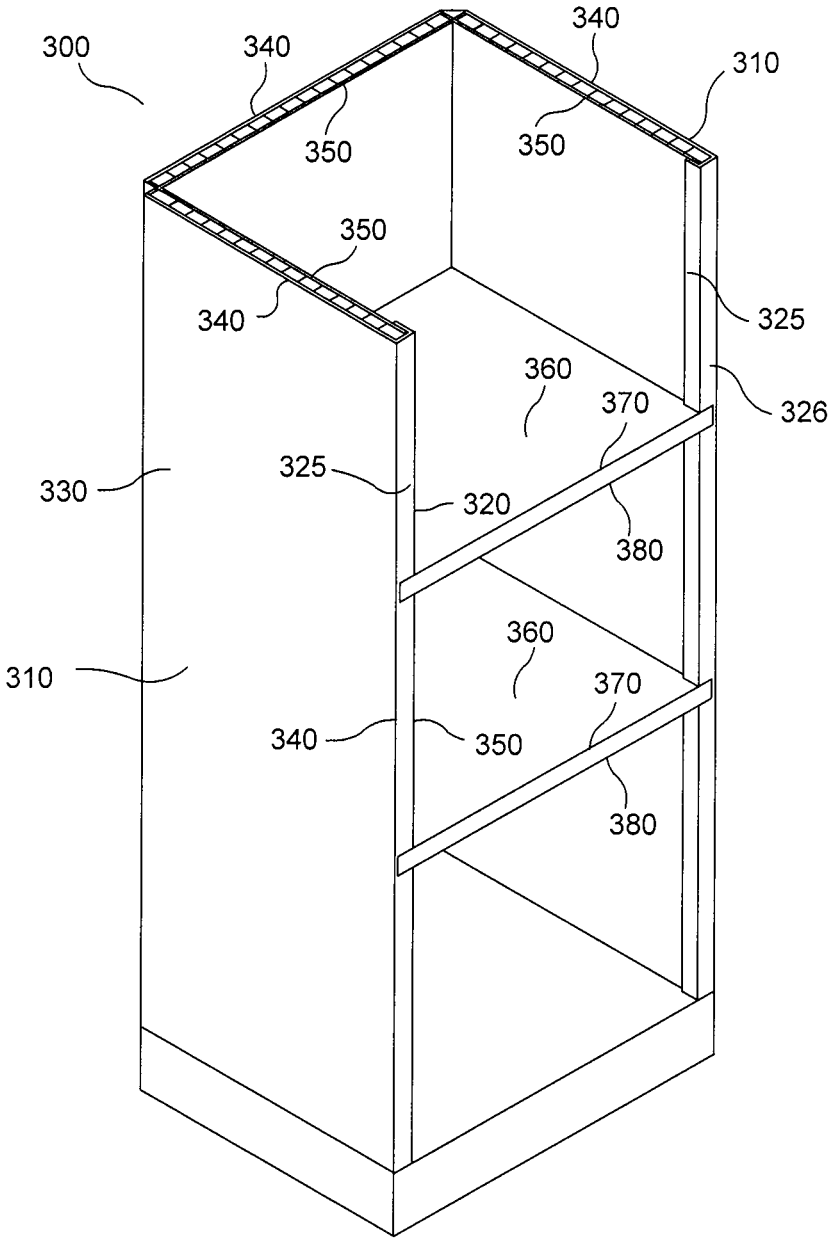
FIG. 5 is a perspective view of a shelving display constructed using the method of FIG. 1.

In another embodiment, as shown in FIG. 5, a display shelving unit 300 can be provided having side walls 310 that have a low-density core 320 and a facing 330 similar to the low-density core and facing described above. The edges 340, 350 of the side walls 310 can have the facing 330 scored and folded as described above to provide crisp, uniform edges. Facing 330 is folded around edge 340 to the front-facing portion 325 of the wall 310, and further around the edge 350 and adhered to an area 326 of the inside-facing portion of the wall 310. Further, the shelves 360 of the shelving can also have a facing that is scored and folded along edges 370, 380 as described above, providing crisp uniform edges for the cabinets. Such edges give the shelf more resistant to any impact along the edges, and the facing will be less subject to wear and tear along the edges.

In another embodiment as shown in FIG. 6, a receptacle 400 can be provided having side walls 410 that can have a facing 440 that is scored and folded along edges 420, 430 as described above. The facing 440 provided over the low-density core 450 allows for a sheeting material where printing 460 may be applied to such receptacle 400. The bends and score lines along edges 420, 430 can be configured to maximize a flat, printable area along the side walls 410. Printing can also be provided along the inner surface 470 of the receptacle 400 when the facing is extended to cover the inner surface 470. The color of the inner surface 470 can be different from the color of the side walls 410, for instance either as a cost-saving measure, or to provide a visual contrast.

Figure 7:
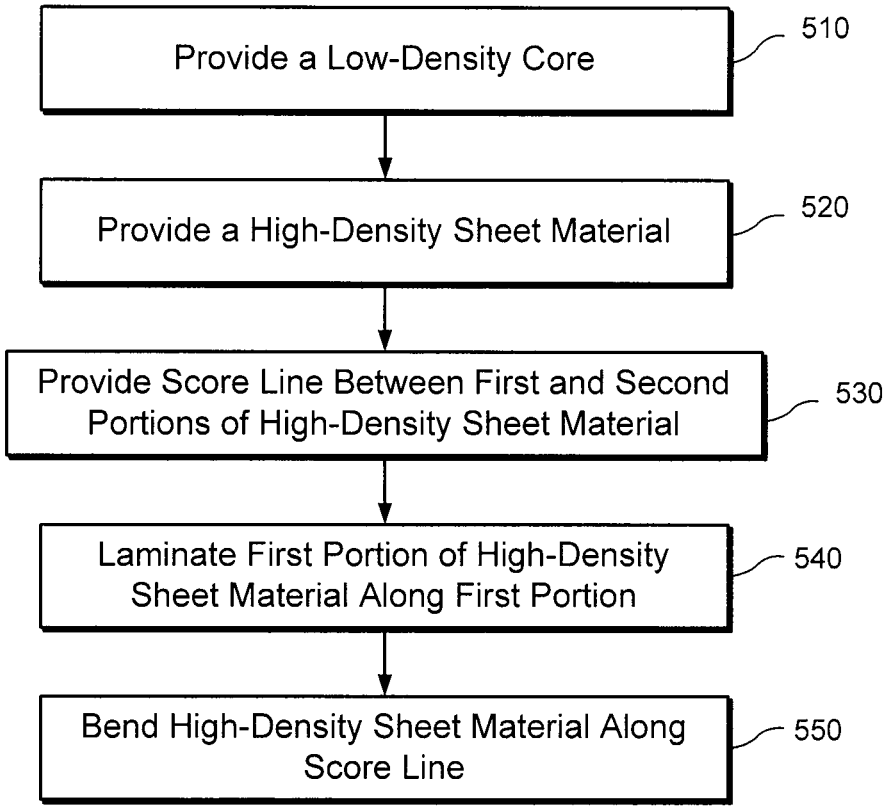
FIG. 7 is a flow diagram according to an exemplary embodiment of a method of the invention.

FIG. 7 illustrates a flow diagram of an exemplary method of manufacturing a panel structure having a facing along a low-density core. Initially, e.g., at procedure 510, a low-density core can be provided that is configured for withstanding loads normal to a first primary surface. Then, at procedure 520, a first facing of a high-density sheet material can be provided that includes a first portion and a second portion. A score line can be provided on the first facing between first and second portions at procedure 530.

At procedure 540, the first portion of the first facing can be laminated onto the core along a first primary surface in an association to cooperatively resist bending loads and loads along the primary surface. The score line can be created before the lamination, or can be created after the lamination of the first portion on the core. Then, at procedure 550, the second portion of the first facing can be bent with respect to the first portion of the facing along the score line to produce a crisp and uniform bend such that the second portion of the first facing extends on a side of the core along a secondary surface, which is non-parallel to the first primary surface, such as, e.g., a side surface of the core.

Panel structures created according to the described procedures result in panel edges between adjacent surfaces of the high density facing that have a very tight radius as compared with facing material that has been bent over the core without first scoring the material, or compared to low density sheet material bent around a core, since this will typically crush and its corners will take up a relatively large part of the edge. Scoring the high-density facing before bending around the side of the core provides bends that can take up very little of the space on the side surface of the panel, and preferably also of the portion of the principal surfaces adjacent thereto. This allows the dimensions of the panel to be tightly controlled.

With sharper edges, various benefits may be realized. These include a larger printable edge surfaces for printing textual information or displaying images. Further, a finer fold allows for more precise sorting and stacking of the panels during production and shipping. The edges of the panels may also be strengthened, meaning that the are less prone to dents or other damage during normal use.

Figure 8A:
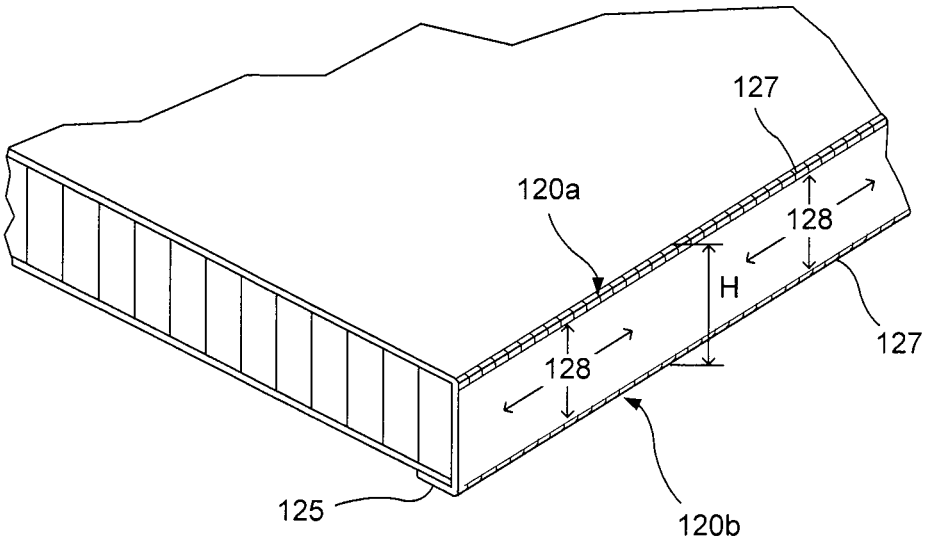
FIGS. 8*a*-8*b* show enlarged views of the panel structure of FIG. 1*e*.
Figure 8B:
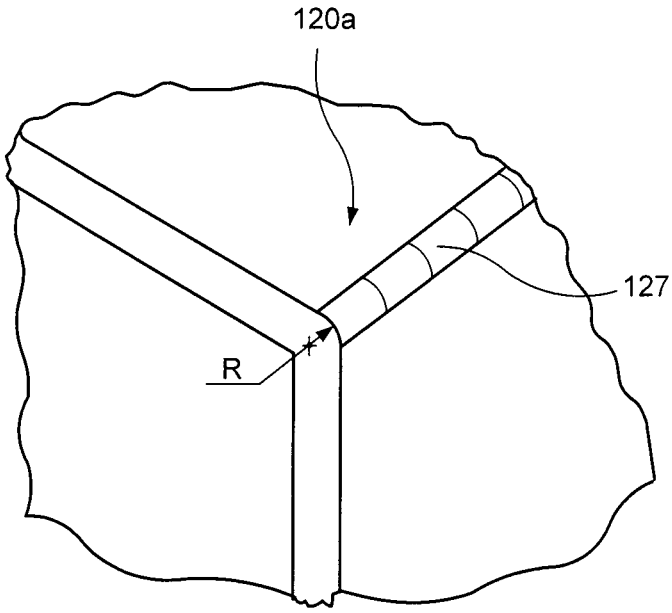

Referring to FIGS. 8*a* and 8*b*, an enlarged view of a lateral side of a panel is shown, as in FIG. 1*e*. The scored portions 120*a* and 120*b* with sharp bends 127 are visible, between which, defined by the length H, is an area 128 suitable for printing textual information. With the sharp bends 127, a greater area 128 is available for printing than in known panels. The sharp bend corresponding to scored potion 120*a* is shown enlarged greater in FIG. 8*b*, with a radius R defining the sharp curvature.

One having ordinary skill in the art should appreciate that there are numerous shapes and sizes of the panel structure 100 described above, for which there can be a need or desire to load items thereon according to exemplary embodiments of the present invention. Additionally, one having ordinary skill in the art will appreciate that although the preferred embodiments illustrated herein reflect a generally flat and rectangular panel structure 100, the panel structure 100 can have a variety of shapes and sizes. Also, the scored and folded facing or other sheeting can be provided on one or more sides of the panel to close off additional or all of the lateral sides of the panel.

As used herein, the terms "front," "back," "upper," "lower," "side" and/or other terms indicative of direction are used herein for convenience and to depict relational positions and/or directions between the parts of the embodiments. It will be appreciated that certain embodiments, or portions thereof, can also be oriented in other positions.

In addition, the term "about" should generally be understood to refer to both the corresponding number and a range of numbers. In addition, all numerical ranges herein should be understood to include each whole integer within the range. While an illustrative embodiment of the invention has been disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. A method of forming a panel structure, comprising:

providing a laminated structure that includes:

a low-density core having more than about 70% airspace configured for withstanding loads normal to a first primary surface, and a high-density first facing having less than about 10% airspace, the first facing including a first portion laminated to the core along the first primary surface in an association that cooperatively resists bending loads and loads along the primary surface;

using a cutting element to completely cut through the low-density core sufficiently deeply to completely cut off a portion of the core to create a new edge of the core and, simultaneously, score the first facing to create a score line at the new edge between the first portion and a second portion of the first facing;

removing the cut-off portion from the remaining portion of the core and first facing so that the second portion of the first facing extends beyond the remaining portion of the core; and bending the second portion of the first facing with respect to the first portion of the facing along the score line to produce a crisp bend such that the second portion of the first facing extends on a side of the core along a secondary surface, which is non-parallel to the first primary surface.

2. The method of claim 1, further comprising laminating the second portion to the core.

3. The method of claim 2, wherein the second portion is laminated onto the secondary surface of the core.

4. The method of claim 3, wherein the first facing includes a third portion and another score line between the second and third portions, the method further comprising bending the third portion with respect to the second portion along the other score line, to produce a crisp bend onto a second primary surface on an opposite side of the core from the first primary surface.

5. The method of claim 4, wherein the laminated structure includes a high-density second facing having less than about 10% airspace laminated on the second primary surface, the method further comprising laminating the third portion to the second facing.

6. The method of claim 5, wherein the third portion is laminated onto an outer surface of the second facing on the second primary surface.

7. The method of claim 1, further comprising:

laminating the first portion of the first facing onto the core to provide a laminated structure; and scoring the first facing to provide the score line, wherein the scoring is conducted after the lamination of the first portion onto the core.

8. The method of claim 1, further comprising:

providing a second score line between the second portion and a third portion of the first facing; and bending the third portion of the first facing with respect to the second portion of the facing along the second score line to produce a bend such that the third portion of the facing extends along a bottom surface of the core that is opposite to the first primary surface.

9. The method of claim 1, wherein the first facing and core are made of a paper material.

10. The method of claim 1, wherein the first facing is a multilayered sheet material.

11. The method of claim 1, wherein the core comprises a honeycomb material.

12. The method of claim 1, wherein the panel structure is formed as a pallet, the method further comprising attaching a runner along a bottom surface of the pallet.

13. The method of claim 1, wherein the high-density first facing has substantially no air space.

14. The method of claim 1, wherein the first facing includes a third portion, the method further comprising:

scoring the first facing at a second score line between the second and third portions;

bending the third portion over the second portion of the first facing along the second score line such that the first facing is folded over itself to define a folded portion that includes the second and third portions folded over each other; and bending the folded portion of the first facing with respect to the first portion of the first facing along the first score line to produce a crisp bend such that the folded portion of the first facing extends on a side of the core along a secondary surface that is non-parallel to the first primary surface.

15. The method of claim 14, further comprising:

scoring the folded portion at a third score line; and bending the folded portion along the third score line to produce a crisp bend onto a second primary surface of the core on an opposite side of the core from the first primary surface.

16. The method of claim 1, wherein the second portion is bent along the score line onto the new edge of the core.

17. The method of claim 1, wherein the cutting element is a single cutting element.

18. The method of claim 1, wherein the cutting element is a rotary cutter.

* * * * *